US008444825B2

(12) United States Patent
Pitzler et al.

(10) Patent No.: US 8,444,825 B2
(45) Date of Patent: May 21, 2013

(54) FORMING SIEVE FOR THE WET END SECTION OF A PAPER MACHINE

(75) Inventors: Joachim Pitzler, Reutlingen (DE); Oliver Baumann, Gomaringen (DE)

(73) Assignee: Wangner GmbH, Reutlingen (DE)

( * ) Notice: Subject to any disclaimer, the term of this patent is extended or adjusted under 35 U.S.C. 154(b) by 0 days.

(21) Appl. No.: 12/763,305

(22) Filed: Apr. 20, 2010

(65) Prior Publication Data

US 2010/0314064 A1 Dec. 16, 2010

Related U.S. Application Data

(63) Continuation of application No. 10/591,112, filed as application No. PCT/EP2005/004787 on May 3, 2005, now Pat. No. 7,727,360.

(30) Foreign Application Priority Data

May 19, 2004 (DE) ..... 20 2004 008 078 U
Jun. 11, 2004 (DE) ..... 20 2004 009 300 U

(51) Int. Cl.
*D21F 1/10* (2006.01)
*D06C 15/02* (2006.01)

(52) U.S. Cl.
USPC ..... 162/348; 162/903; 162/362; 264/284

(58) Field of Classification Search
USPC ..... 162/116, 348, 358.2, 306, 900–904, 162/361, 362; 428/220, 156, 170, 171, 172, 428/213; 139/383 A, 425 A; 264/280, 284; 28/116, 134, 138, 142, 158, 163
See application file for complete search history.

(56) References Cited

U.S. PATENT DOCUMENTS

| | | | | |
|---|---|---|---|---|
| 2,292,411 | A * | 8/1942 | Sutton | 245/8 |
| 3,573,164 | A | 3/1971 | Friedberg et al. | |
| 3,905,863 | A | 9/1975 | Ayers | |
| 4,239,065 | A | 12/1980 | Trokhan | |
| 4,457,968 | A | 7/1984 | Harvey | |
| 5,407,737 | A * | 4/1995 | Halterbeck et al. | 442/195 |
| 5,840,637 | A * | 11/1998 | Denton et al. | 442/361 |
| 7,514,030 | B2 | 4/2009 | Nilsson et al. | |

FOREIGN PATENT DOCUMENTS

| | | |
|---|---|---|
| DE | 1115 699 | 10/1961 |
| DE | 2 012 327 A | 7/1979 |
| DE | 41 37 984 C1 | 11/1991 |
| EP | 0 544 167 A1 | 6/1993 |
| WO | WO 97/01431 A1 | 1/1997 |

OTHER PUBLICATIONS

Calendering, Clothmen:Textile Dictionary, retrieved Apr. 10, 2012, http://www.clothmen.com/dictionary.php?alpha=All&id=1013.*
International Search Report for PCT/EP2005/004787; date of mailing Jul. 27, 2005.
Search report for German Application No. DE 20 2004 009 300.6; date of mailing Aug. 10, 2005.

* cited by examiner

*Primary Examiner* — Eric Hug
(74) *Attorney, Agent, or Firm* — Myers Bigel Sibley & Sajovec

(57) ABSTRACT

A sieve for the wet-end section of a paper machine is described, in which the sieve has been compressed by at least one of increased temperature, pressure and/or moisture. Such a treatment leads to a sieve which has at least one side wherein the thread floats and knuckles are reshaped and the sieve presents at least one substantially flatter surface for the production of paper. This process does not cause any physical damage to the surface of the sieve, as current techniques of abrasively polishing the surface do, and therefore leads to cloths with improved properties and lifetimes.

19 Claims, 7 Drawing Sheets

FORMING SIEVE FOR THE WET END SECTION OF A PAPER MACHINE

RELATED APPLICATIONS

This application is a continuation of and claims priority to U.S. application Ser. No. 10/591,112, filed on Aug. 31, 2006 which claims priority to PCT Application No. PCT/EP2005/004787, filed on May 3, 2005, which claims priority from German Utility Model Application Nos. DE 20 2004 009 300.6 filed Jun. 11, 2004 and 20 2004 008 078.8 filed May 19, 2004, the disclosure of each of which is hereby incorporated herein by reference.

FIELD OF THE INVENTION

The present invention relates to a single- or multiple-layered forming sieve for the wet end section of a paper machine, according to the pre-characterizing section of Claim 1.

BACKGROUND OF THE INVENTION

In the conventional Fourdrinier paper-manufacturing method, an aqueous pulp or suspension of cellulose fibres (known as "paper stock") is placed onto the upper surface of a so-called endless web made of wire and/or a synthetic material. This wire web acts as a filter, which causes the cellulose fibres to be separated from the aqueous medium and form a so-called wet-paper sheet. During formation of this wet-paper sheet, the forming sieve acts as a filter which separates the aqueous medium from the cellulose fibres, as the aqueous medium passes through the openings in the sieve.

To accelerate the removal of the water, the filtering process is very often carried out with the additional action of a vacuum applied to the underside of the sieve, i.e. on the machine side. Once the paper sheet has left the forming end section it is transferred to a press section of the paper machine, at this point it is guided through the gap between a pair, or several pairs, of pressure rollers, over which is stretched another fabric: a so-called "press felt". The pressure of the rollers acting on the paper sheet removes additional moisture, and is frequently enhanced by the presence of a "mat" layer within the press felt. After passing through the pressing section, the paper is sent to a drying section of the machine for further removal of moisture. After drying, the paper is ready for any secondary processing which may be undertaken and finally packing.

The sieves used in paper-machines are made available as endless webs, and are manufactured by one of two methods. According to the first method, the free ends of individual flat woven webs are connected together by a procedure known as "splicing", and in so doing the endless web is formed. In flat-woven paper-machine sieves formed in this way, the warp threads run in the machine direction, and the filling or weft threads run in the cross direction. According to the second production technique, the paper-machine sieves are directly fashioned in the form of a continuous strip, by the so-called endless-web method. In this method, the warp threads run in the cross direction of the machine, with the weft threads in the machine direction. Within the relevant literature, abbreviations for these terms are commonly used, with MD standing for "machine direction" and CMD for "cross machine direction".

Within the wet end section of a paper machine, it is extremely important to maintain the cellulose fibres in the suspension on the paper side of the sieve, and to avoid markings within the forming sheet. These markings can occur when individual cellulose fibres are oriented within the paper sheet, such that their ends coincide with interstices between the individual threads of the sieve. In general, an attempt is made to solve this problem by providing a permeable sieve structure which is possessed of a coplanar surface, and which further allows the paper fibres to form a bridge over adjacent threads in the fabric and not penetrate into the interstices between them. As used herein, "coplanar" means that the uppermost parts of the threads, those which define the paper-forming surface of the sieve and are termed floats or knuckles respectively, lie at substantially the same height, so as to present a surface which is substantially "planar". Fine paper, such as that used for high-quality printing, carbonization, cigarettes, electrical capacitors, and other papers of similar quality, has previously been produced on very finely woven sieves, as these present the flattest surfaces.

In order to make the surface of the cloth as close to planar as possible, particularly in the case of forming sieves, the surfaces are very often ground down with fine-grain emery paper. Such grinding is intended to improve the topography of the paper, and lead to a better final surface. Unfortunately, by grinding the surface in this way, the thread floats and knuckles of a sieve become damaged; this can be seen in FIGS. 3 and 4 when compared with FIGS. 1 and 2. FIG. 1 shows a section of a forming sieve which has not been processed, that is the floats or knuckles have not been ground with emery paper. FIG. 2 shows a section of the sieve according to FIG. 1, but under greater magnification.

FIGS. 3 and 4 correspond to the photographs shown in FIGS. 1 and 2, with the exception that in the sieve according to FIGS. 3 and 4, the topography of the paper has been evened out by grinding down the floats or knuckles. Whilst this particular levelling procedure does not reduce the interior volume of the sieve, the thickness is slightly reduced. This has further disadvantageous side effects, in that the stability of the sieve is adversely affected as a result: primarily, the loss of material entails a lower sieve stiffness. Furthermore, it has been found that as a result of this mechanical intervention, the sieve suffers from increased abrasion and hence a shorter operating life. In the case of threads with small diameters, e.g. 0.11 mm to 0.13 mm, the grinding process reduces the cross section of the threads by 30-40%. Such severe mechanical alteration of the threads, and hence of the sieve, can be seen as the root cause of the reduction in sieve stiffness. This is a further problem, as current trends in the paper industry are moving increasingly towards even thinner sieves with correspondingly thinner thread diameters. With this progression, limits are being placed on the mechanical alterations possible in order to produce coplanar sieve surfaces.

To further elucidate the state of the art as shown in FIGS. 1 to 4, reference is also made to FIGS. 5 and 6 as well as 7 and 8. FIG. 5 shows the contact surface of a sieve according to FIGS. 1 and 2, the untreated sieve, wherein about 30% of the total surface comprises the contact surface of the sieve. FIG. 6 shows the "standard" shape of floats and knuckles present in an untreated sieve, according to FIGS. 1 and 2. FIGS. 7 and 8 detail the structure of a ground-down sieve, wherein removal of 0.02 mm from the protruding floats and knuckles, increases the contact surface of the sieve to about 34%. The float or knuckle shape after grinding is shown in FIG. 8.

An objective of the current invention, is the preparation of sieves that present a highly coplanar surface, at least on the paper side, but preferably on both the paper and machine sides. This is to be achieved, even for sieves that are considerably thinner than those disclosed in the art, and have correspondingly reduced thread diameters. In light of the various problems presented above, this objective is to be achieved in particular for so-called forming sieves, i.e. sieves intended for use in the wet end section of a paper machine.

SUMMARY OF THE INVENTION

The above objective is achieved by the characterizing features given in claim 1, with advantageous further developments and embodiments being described in the subordinate claims.

A single- or multilayered forming sieve for the wet end-section of a paper machine with upper machine-direction, MD, and cross-machine-direction, CMD, threads facing the paper side, and lower MD and CMD threads facing the machine is disclosed. The forming sieve having, at least the paper-side thread inflection regions reshaped by means of one or a combination of temperature, pressure and/or moisture. A method for achieving such reshaping is given in claim 15, wherein rollers are used for the application of the pressure and/or temperature.

DETAILED DESCRIPTION OF EMBODIMENTS OF THE INVENTION

The production of sieves for paper machines in the current invention, is based around a system of compacting or "hot calendering" the fabric making up the sieve, in a press arrangement. This action is undertaken at least at one of, or a combination of: an elevated pressure, an elevated temperature and/or at an elevated moisture level, for a specific time; this time being a result of the chosen threads, and the desired properties of the finished product.

When fabrics which are possessed of an endless structure are employed, that is there are no ends making up a joining seam, they are usually configured with two warp thread systems. The calendering, or compacting, of this fabric is accomplished between at least two rollers, as can be seen in the examples shown in FIG. 9. Whilst three possible structures are shown in this figure detailing apparatus for compacting the fabric, these are not to be considered as limiting the invention in any way, and are shown as examples only.

Figure 9:
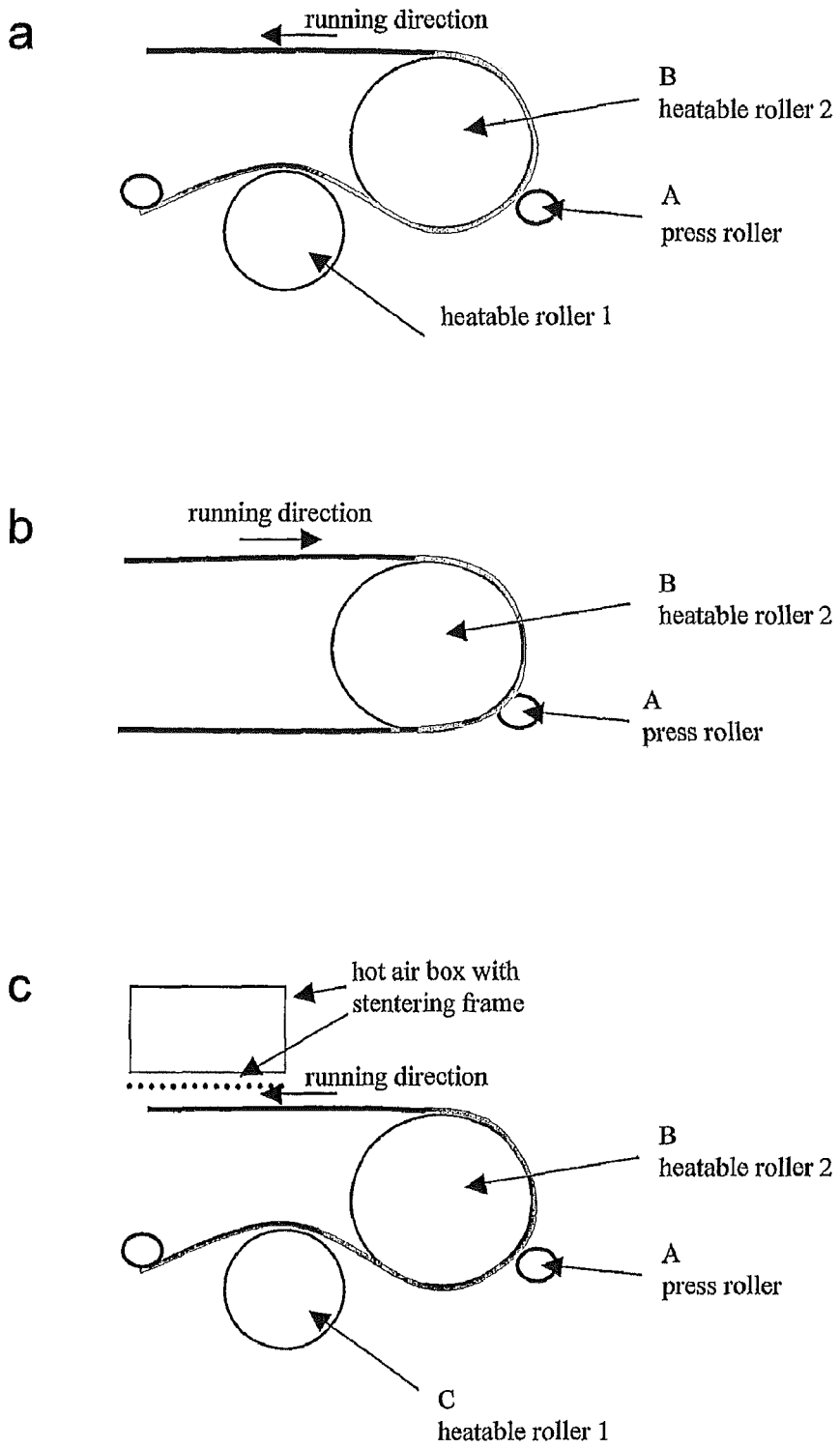
FIGS. 9*a*-9*c* illustrate different roller configurations that may be employed with sieves of the present invention.

FIG. 9*b* shows the simplest structure, in that only two rollers are provided, between which the fabric is compacted. In order to increase the usable area of the heated roller, which in turn means that the fabric will be in contact with the heat for a greater length of time, a third roller c can be provided as shown in FIG. 9 *a* and FIG. 9 *c*. Furthermore, these additional rollers can be heatable if further heat application to the fabric is required in the process. The specific number and relative positions of the fabric, can be chosen depending upon the precise requirements of the fabric and the final desired structure at the surface thereof.

To compact or calender the fabric of the sieve, requires the provision of two rollers which can be brought together and a desired pressure applied between them. These are shown by reference numerals A and B in FIG. 9. Here, the sieve fabric passes between the gap provided between the two rollers, and the required pressure is applied; this pressure, commonly lies between 10 and 40 kPa. The roller A, called a press roller, is formed of a plurality of segments which run along the width of the sieve fabric and can be tuned to provide different pressures across the sieve. This plurality of press rollers, allows the final sieve to be formed with a specific and selectable cross sectional profile.

As shown in the examples of FIG. 9, at least one of the rollers can be heated, with the temperature lying somewhere between 100-190° C., although it has been found that most processes are undertaken in the range 140-170° C. The specific temperature chosen will depend upon the thread within the fabric, and the final desired structure to the surface of the sieve. It is possible to heat one or both sides of the fabric as it is being compacted, and it is further possible to adjust the temperature profile along the width and length of the fabric during such processing. This will result in a fabric for which, at each point along its length and width, the specific temperature and pressure can be individually tailored to suit the desired final requirements of the sieve in a targeted manner.

For fabrics that are possessed of two ends, which are joined together via a seam to form the endless structure, the compacting process is a little different. Initially, it is necessary to specifically control the pressures which are applied to the starting and end points of the fabric. This is achieved by providing a ramp control to the applied pressure, wherein the machine is aware of the start and end points to the fabric, and thus a process is achieved which suffers from no transitions. All other processing of the fabric follows the method detailed above for the preformed endless fabric.

The specific tension applied to the fabric during the calendering process, whether preformed or one with a seam, is dependent upon the individual fabric design. During the compacting process the fabric will change its length by up to +1-1.5%, a fact which requires taking into account at the fabric forming stage and prior to the calendering process. Furthermore, changes to the width of the fabric, which lie in the range 0-3% are generally monitored, and compensated for with simultaneous thermal treatment of the fabric.

As shown in FIG. 9*c*, an additional drying unit can be provided which applies heat to the fabric after the compacting process. This is shown in the figure as being provided by a heat box with a tenter for drying the fabric over. Clearly, other options exist for this drying stage, and are not limited to that disclosed in the drawings.

The threads which form the fabric of the sieves can comprise or contain a polymer such as one, or a combination of: a polyester, a polyamide and/or a polyolefin. Furthermore, the calendering process as disclosed can readily be implemented on sieves which have warp threads present on the paper side with a diameter of between 0.09 and 0.20 mm, and machine-side warp threads having a diameter of between 0.15 and 0.30 mm. In particular the paper side threads are chosen with a diameter of 0.13 mm and the machine-side threads with a diameter of about 0.18 mm. Additionally, the compressive process can be used on fabrics which are possessed of one or multiple layers.

Figure 1:
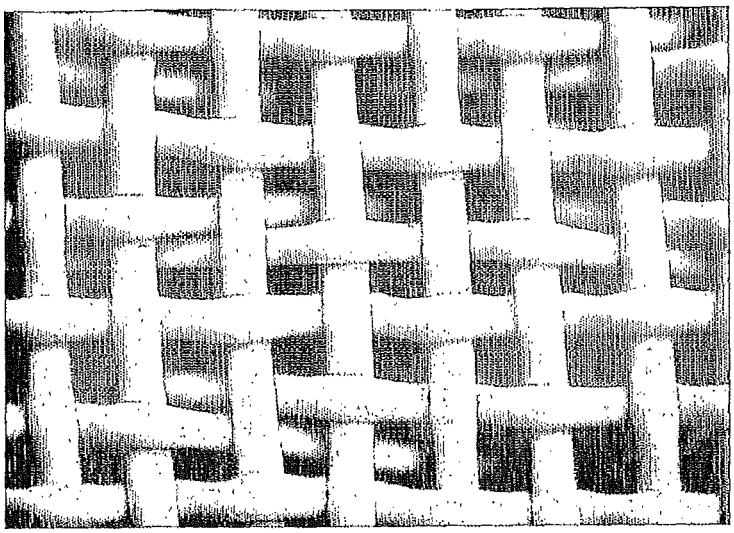
FIG. 1 shows a section of a forming sieve which has not been processed; that is, the floats or knuckles have not been ground with emery paper.
Figure 2:
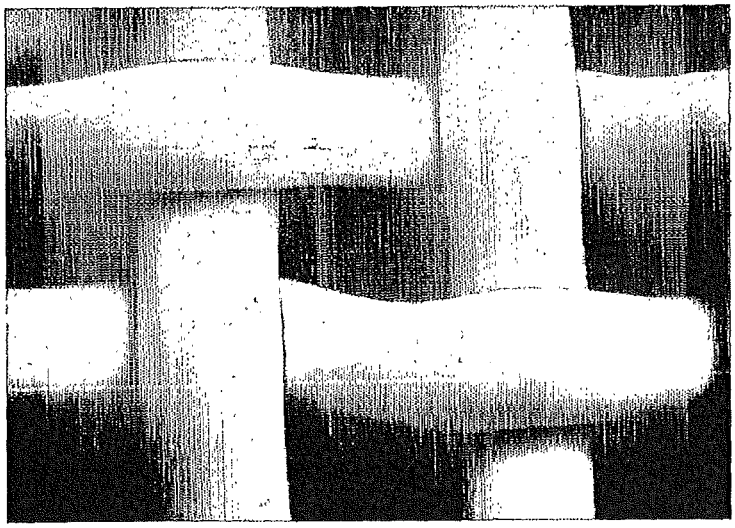
FIG. 2 shows a section of the sieve according to FIG. 1, but under greater magnification.
Figure 3:
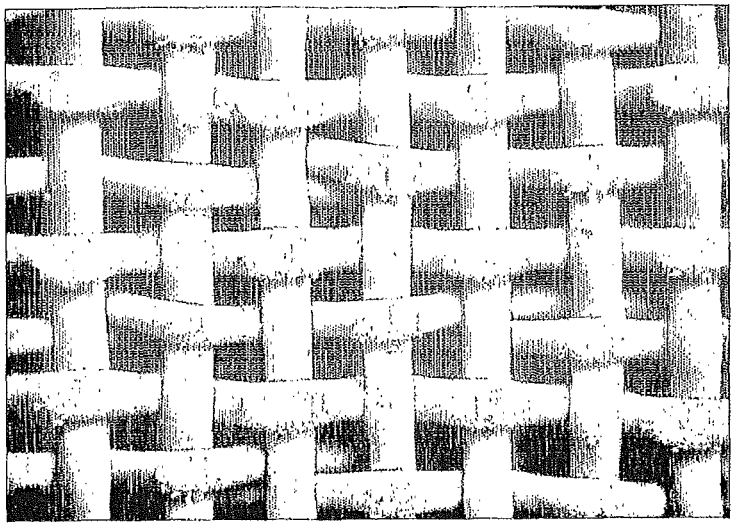
FIGS. 3 and 4 correspond to the photographs shown in FIGS. 1 and 2, with the exception that in the sieve of FIGS. 3 and 4, the topography of the paper has been evened out by grinding down the floats or knuckles.
Figure 4:
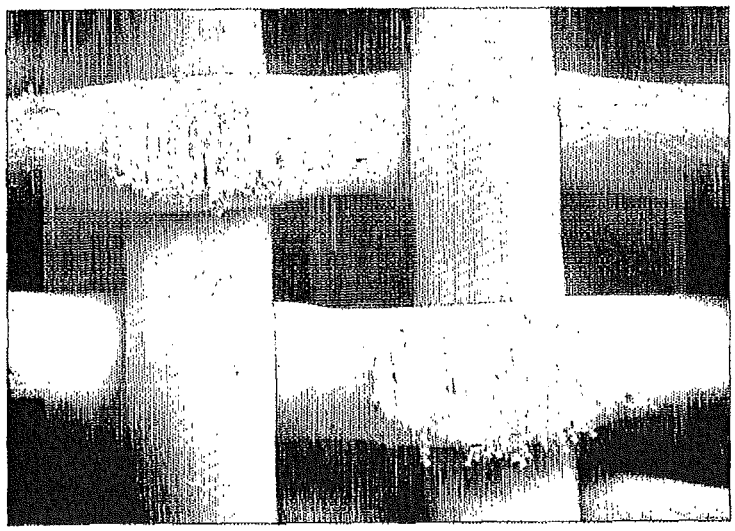
Figure 8:
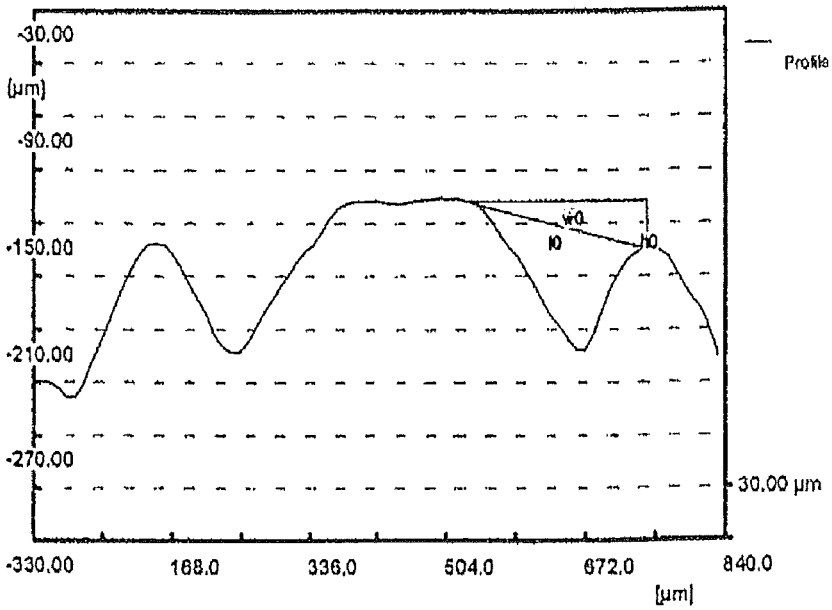
Figure 10:
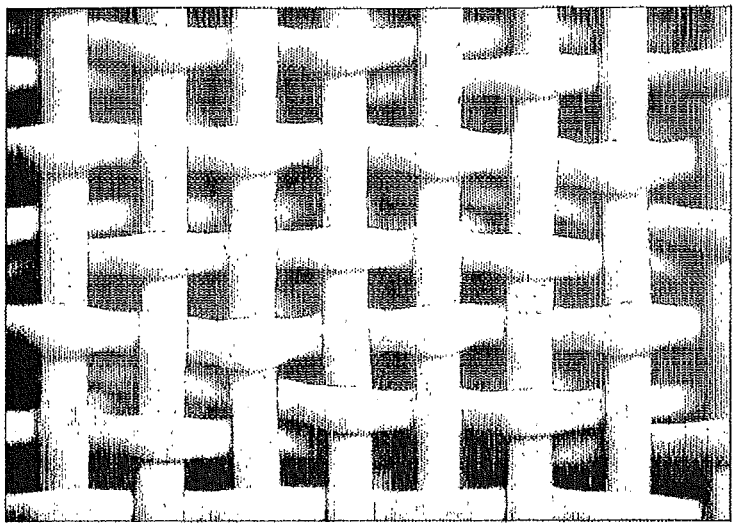
FIG. 10 shows a section of a forming sieve according to embodiments of the present invention after the sieve has been processed.
Figure 11:
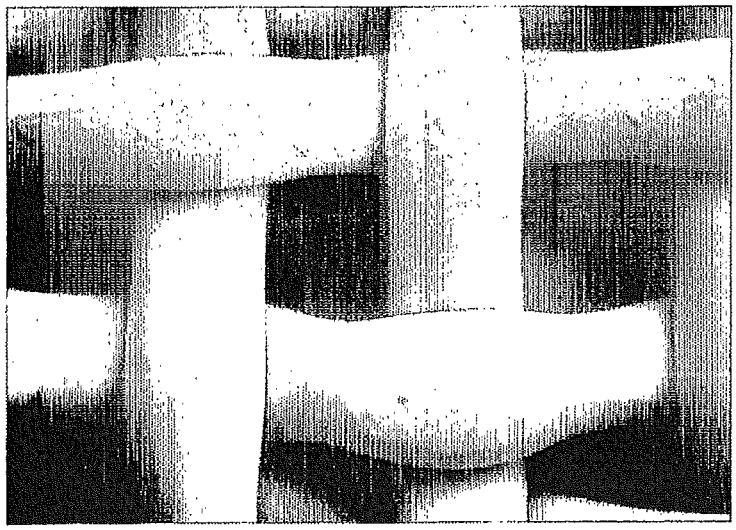
FIG. 11 shows a section of the sieve according to FIG. 10, but under greater magnification.
Figure 12:
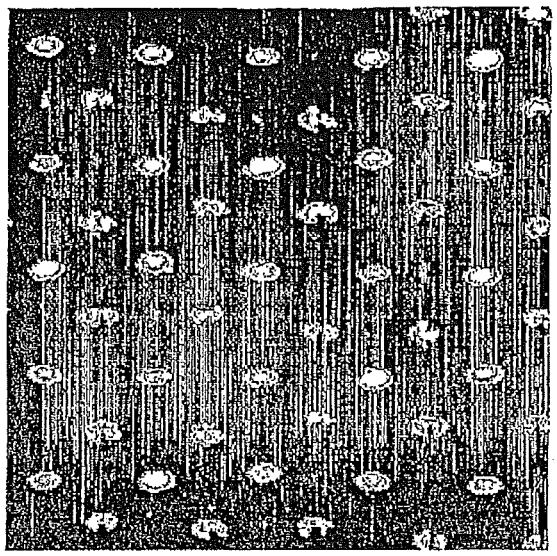
FIG. 12 shows the contact surface of a sieve according to FIGS. 10 and 11.

As is shown in FIGS. 10 and 11, the fabrics processed according to the current invention, have a substantially different structure to those processed with the conventional grinding techniques. The knuckles or floats of the interwoven threads, can be seen to have a compacted or flattened shape on the side facing the paper and/or the papermaking machine. The key difference here, however, is that the floats or knuckles are not mechanically damaged as they are when ground down; compare FIG. 11 with FIG. 4. In addition to this, there is the further advantage that the calendered fabric has no loss of material, as FIG. 12 shows when compared with FIG. 8, which removes the problems associated with the sieves having a reduced stiffness.

The protruding knuckles or floats (10), can be seen in FIGS. 10 and 11 to be somewhat flattened as a result of the compacting. This produces a relatively broad "thread ellipse" (11), which will run quietly within the paper machine as the fabric moves. As a result of this "thread ellipse", the width of the permanently flattened floats and knuckles is greater than the diameter of the remainder of the thread, which is best observed in FIG. 11. Indeed, it is preferable that the width of the flattened floats and knuckles be about 5-15% greater than the diameter of the remainder of the thread. Furthermore, the height of the flattened floats and knuckles is reduced by about 10-30%, and preferably is approximately 20% less than the diameter of the remainder of the thread. That is, compacting has reduced the diameter by about 30-50%.

Figure 5:
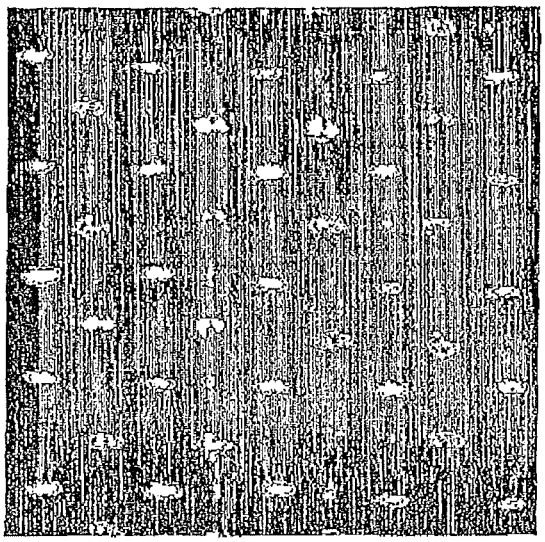
FIG. 5 shows the contact surface of a sieve according to FIGS. 1 and 2, the untreated sieve, wherein about 30% of the total surface comprises the contact surface of the sieve.
Figure 6:
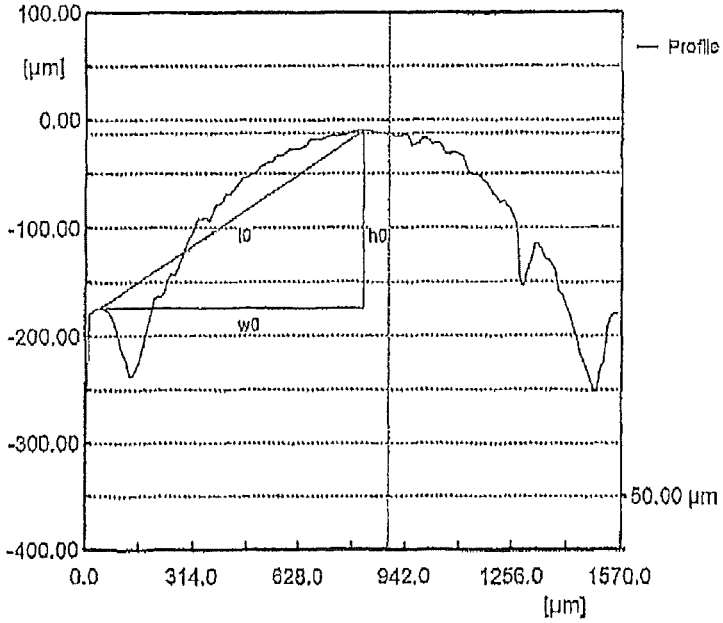
FIG. 6 shows the "standard" shape of floats and knuckles present in an untreated sieve, according to FIGS. 1 and 2.
Figure 7:
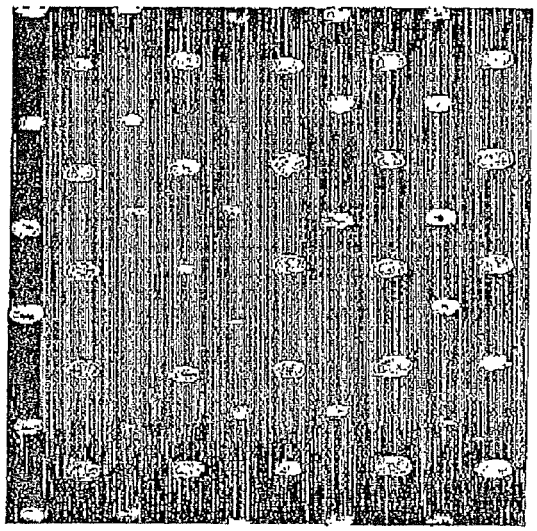
FIGS. 7 and 8 detail the structure of a ground-down sieve, wherein removal of 0.02 mm from the protruding floats and knuckles, increases the contact surface of the sieve to about 34%. The float or knuckle shape after grinding is shown in FIG. 8.
Figure 13:
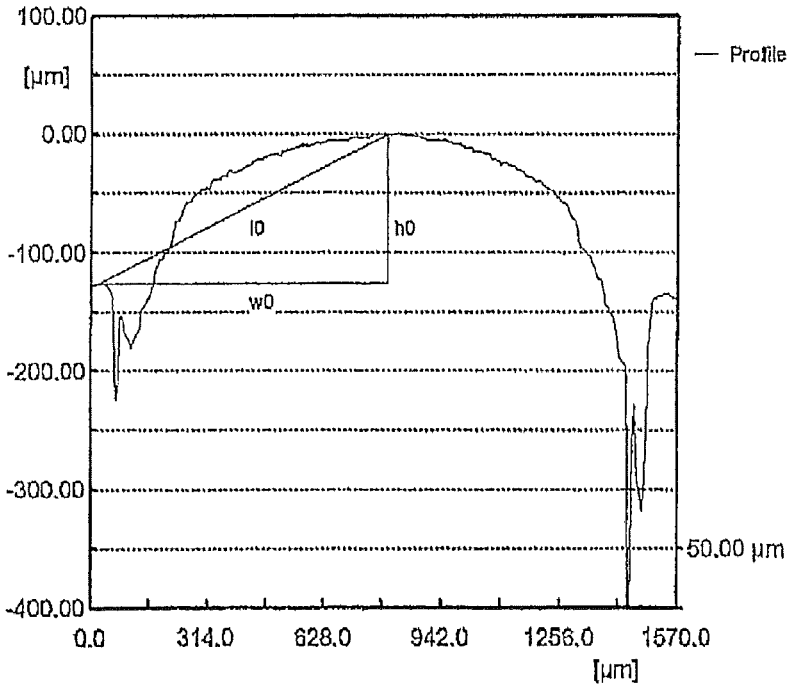
FIG. 13 detail the structure of a processed sieve according to FIGS. 10 and 11.

By compacting the threads in the fabric of the sieve at the float or knuckle points, the contact area of the sieve with the paper is increased by around 25-30%, when compared with an untreated sieve. This increase, leads to a sieve which is possessed of a contact area that is around 40-45% of the total area of the sieve. Such a measurement can be seen in FIG. 4, wherein a treated fabric is shown to have a contact area of 41% of its total surface area. Comparing FIG. 13 with both of FIGS. 5 and 7, it is clear that the current invention shows greatly improved surface characteristics to the fabric over the prior art techniques.

In addition to the increase in contact area for the calendered fabrics, these sieves have much smoother surfaces, when compared with untreated or ground fabrics, which leads to a much improved final paper topography. Moreover, a sieve which has appropriately compacted floats on the paper-machine side in addition to the paper side, shows no different weft knuckle heights when the fabric is loaded, as would be caused by different materials: this again improves the final paper surface as the knuckle heights are reduced on the paper machine side, other problems associated with new sieves running on the machine are dramatically reduced. Of such problems, the most significant are those associated with the load which needs to be supported by the paper machine, and the starting up of the machine with a new sieve that has not been properly run-in. In particular, as a result of the broad, already formed, "thread ellipse", a sieve which is adapted to the machine is more rapidly obtained. In a papermaking machine a sieve which is constructed in accordance with the present invention, can start up more rapidly, it requires less subsequent adjustment and begins quiet running sooner, this is when compared with currently employed sieves.

Sieves with the float or knuckle shape in accordance with the invention, exhibit no, or at least greatly reduced, differences at the transition point between the seam region and the solid fabric. This leads to the sieves producing no marking on topographically sensitive kinds of paper. As a result of the slightly broader and flatter float shapes, the sieve exhibits higher stability and stiffness, because the interwoven threads are displaced less with respect to one another.

Clearly, the process of calendering a fabric leads to a permanent reduction in the fabric thickness as a result of the applied pressure. Depending upon the specific treatment applied, the thickness of the fabric can be reduced by between 1 and 20% of the original. In order to achieve this, the inflection heights and shapes of the individual threads running through the fabric are permanently altered. As there is no loss of material in this technique, merely a compressing, the weight per unit area of the fabric remains constant.

In addition to the geometry of the threads within the sieve being altered after calendering, the internal volumes within the body of the fabric are permanently reduced. Obviously, when the fabrics are compressed and the thread geometry adjusted, it is necessary for the threads to move somewhere, and in this case there is a reduction in the void size lying between them as they are brought closer together. This reduction in cavity size between the fibres has advantageous effects for the sieves as they run on the paper making machines. When the sieve is being used to hold the paper stock as the aqueous medium is being removed, it is possible for the cavities within the fabric to induce turbulence as they move. Such turbulence often produces the unwanted side effect of dragging water along with the cavities, as the sieve moves through the machine. Clearly, if the water remains within the sieve, the drying of the paper stock is adversely affected. With the reduction in cavity size associated with fabrics treated by the current process, however, the problems associated with turbulence and water logging are lessened. Once again, depending upon the specific fabric and treatment thereto, the cavities can be reduced in size by between 1 and 15%.

Further advantages result from the change in inflection points between the threads in the fabric, and from their altered geometry. With the increase in contact surface area to the fabric, there is a related increase to the level of friction between the sieves and the paper forming machine. This leads to a reduced delay in the movement of the fabric when the machinery is initially started, and further reductions in the transverse motion whilst the machine is running. Such improvements increases the efficiency of the paper drying process, whilst additionally requiring less adjustment to the belts with prolonged usage. Moreover, in the seam regions where present, the thread-thread friction is increased with this change in the inflection between the warp and weft threads, the result being an increase in the seam stability and strength.

Standard, that is un-calendered, sieves which are formed with a seam, will tend to suffer from inconsistencies in the thickness of the fabric between the regions of the seam and the main body of the fabric. This difference in surface properties can have adverse effects on the paper production, leading to marking of the page, and will also lead to an increased level of wear in this region. The compressing techniques of the current invention, however, alleviate these problems by giving a fabric which has a uniform thickness along its entire length. Furthermore, internal stresses and tensions on the fabric threads which result from these inconsistencies in the un-treated sieves, are substantially equalized in the fabric calendered in accordance with the present invention.

A final property of the fabric that is altered with the compressive treatment, is that of the permeability. It is assumed that it is the compaction of the fabric, giving the reduction in fabric thickness with corresponding changes to the void size and density, which leads to this difference. Dependent upon the initial fabric, and the treatment done thereto, the permeability can be reduced from between 0 and 30%, and this is usually taken into consideration when the specific processing and fabric are being chosen.

While various features and embodiments of the invention are described above, they can readily be combined with each other resulting in further embodiments of the invention.

What is claimed is:

1. Single or multilayered forming sieve for the wet end-section of a paper machine with upper machine-direction, MD, and cross-machine-direction, CMD, threads facing the paper side, and lower MD and CMD threads facing the machine, characterized in that:

at least the paper-side thread floats and knuckles (10) are reshaped by means of one or a combination of temperature, pressure and/or moisture and as a result of the thread inflection regions being reshaped, the reshaping causing the paper-side knuckles to have a width greater than the diameter of the remainder of the threads, the void size lying between the threads (13) is reduced by between 1% and 15% from the original void size prior to inflection region reshaping;

wherein the width of the thread floats and knuckles (10) is greater than the diameter of the remainder of the thread (13), by between 5% and 15%.

2. Sieve according to claim 1, wherein, the threads (12, 13) are made of, or contain, one or more than one of a polymer such as a polyester, a polyamide or a polyolefin.

3. Sieve according to claim 1, wherein, the temperature lies between 100° C. and 190° C.

4. Sieve according to claim 3, wherein, the temperature lies between 150° C. and 170° C.

5. Sieve according to claim 1, wherein, the pressure lies between 10 kPa and 40 kPa.

6. Sieve according to claim 1, wherein, the threads on the paper side have a diameter of between 0.09 mm and 0.20 mm, and the machine-side threads have a diameter of between 0.15 mm and 0.30 mm.

7. Sieve according to claim 6, wherein, the threads on the paper side have a diameter of 0.13 mm, and the machine-side threads have a diameter of 0.18 mm.

8. Sieve according to claim 1, wherein, the height of the thread floats and knuckles (10) is between 10% and 30% less than the diameter of the remainder of the thread (13).

9. Sieve according to claim 8, wherein, the height of the thread floats and knuckles (10) is 20% less than the diameter of the remainder of the thread (13).

10. Sieve according to claim 1, wherein, the thread floats and knuckles comprise that "thread ellipses" (11) extending approximately parallel with the plane of the sieve.

11. Sieve according to claim 1, wherein, the total contact area of the sieve is about 40 to 45% of the total surface area of the sieve.

12. Sieve according to claim 1, wherein, one, or a combination of more than one, of: the thread inflection shape, the width of the thread floats and knuckles (10), the height of the thread floats and knuckles (10), the degree of ellipticity of the threads (13), and the total contact area of the sieve varies across each point of the sieve's width.

13. A method of forming a sieve for the wet end-section of a paper machine, comprising: calendering a sieve fabric with a plurality of rollers at one, or a combination of more than one, of: temperature, pressure and/or moisture, so as to permanently reshape the thread inflection regions at least on the paper-side of the sieve, the reshaping causing paper-side knuckles of the fabric to have a width greater than the diameter of the remainder of the threads of the fabric, wherein as a result of the thread inflection regions being reshaped, the void size lying between the threads (13) is reduced by between 1% and 15% from the original void size prior to inflection region reshaping;

wherein at least one of the plurality of rollers can be heated to apply a specific heat to the sieve during processing, and the temperature can be changed along the length of the roller to apply a specific profile to the sieve.

14. The method according to claim 13, wherein, a least one of the plurality of rollers is formed from a plurality of segments which can be individually adjusted to change the pressure exerted on the fabric, so that the resulting sieve has a tailored cross sectional profile across its width.

15. The method according to claim 13, wherein, the pressure lies between 10 kPa and 40 kPa.

16. The method according to claim 13, wherein, the temperature lies between 100° C. and 190° C.

17. The method according to claim 13, wherein, the temperature lies between 150° C. and 170° C.

18. Single or multilayered forming sieve for the wet end-section of a paper machine with upper machine-direction, MD, and cross-machine-direction, CMD, threads facing the paper side, and lower MD and CMD threads facing the machine, characterized in that:

at least the paper-side thread floats and knuckles (10) are reshaped by means of one or a combination of temperature, pressure and/or moisture and as a result of the thread inflection regions being reshaped, the reshaping causing the paper-side knuckles to have a width greater than the diameter of the remainder of the threads, the void size lying between the threads (13) is reduced by between 1% and 15% from the original void size prior to inflection region reshaping;

wherein, the height of the thread floats and knuckles (10) is between 10% and 30% less than the diameter of the remainder of the thread (13).

19. A method of forming a sieve for the wet end-section of a paper machine, comprising: calendering a sieve fabric with a plurality of rollers at one, or a combination of more than one, of: temperature, pressure and/or moisture, so as to permanently reshape the thread inflection regions at least on the paper-side of the sieve, the reshaping causing paper-side knuckles of the fabric to have a width greater than the diameter of the remainder of the threads of the fabric, wherein as a result of the thread inflection regions being reshaped, the void size lying between the threads (13) is reduced by between 1% and 15% from the original void size prior to inflection region reshaping;

wherein, a least one of the plurality of rollers is formed from a plurality of segments which can be individually adjusted to change the pressure exerted on the fabric, so that the resulting sieve has a tailored cross sectional profile across its width.

* * * * *